United States Patent [19]

Klingenberg

[11] 4,045,320

[45] Aug. 30, 1977

[54] GALVANIC ANODE

[75] Inventor: Øystein F. Klingenberg, Aby I Bamble, Norway

[73] Assignee: A. S. Skarpenord, Langesund, Norway

[21] Appl. No.: 691,146

[22] Filed: May 28, 1976

[51] Int. Cl.[2] ..... C23F 13/00

[52] U.S. Cl. ..... 204/197; 204/286; 204/297 R

[58] Field of Search ..... 204/148, 197, 280, 286, 204/297 R

[56] References Cited

U.S. PATENT DOCUMENTS

| | | | |
|---|---|---|---|
| 2,749,299 | 6/1956 | Wheeler | 204/197 |
| 2,763,907 | 9/1956 | Douglas | 204/197 |
| 2,974,389 | 3/1961 | Tatum | 204/197 |
| 3,001,924 | 9/1961 | Battis et al. | 204/197 |
| 3,671,415 | 6/1972 | King et al. | 204/286 |
| 3,859,197 | 1/1975 | Bouy et al. | 204/286 |

FOREIGN PATENT DOCUMENTS

| | | | |
|---|---|---|---|
| 343 | 1/1901 | United Kingdom | 204/197 |

*Primary Examiner*—T. Tung

*Attorney, Agent, or Firm*—Burns, Doane, Swecker & Mathis

[57] ABSTRACT

A galvanic anode has a body of active material cast on to a metal support which covers at least one side of the body.

8 Claims, 5 Drawing Figures

GALVANIC ANODE

The present invention relates to galvanic anodes which are used for electrolytic protection from corrosion of metal parts which are located in an electrolyte. The principle of this protection is well known and is not further discussed herein, however, as example, the protection of ship's tanks containing sea water as ballast, underwater parts of drilling platforms and underwater pipes for transport of gas and oil from offshore sources, can be mentioned.

Galvanic anodes consist of magnesium, aluminum or zinc, and are cast to a supporting metal part by means of which the anode is suspended or secured to the construction to be protected. The anode material becomes gradually eroded and since it is difficult to predetermine how the errosion will take place, and be distributed over the anode material, it has been a disadvantage of the galvanic anodes known hitherto that a corrosion which is stronger on the one side than the other leads to the loosening of the anode material which falls off in large pieces and is not used up and leads to increased cost of the anode, and, furthermore, the construction may not then be adequately protected. If pieces of the anode material fall from a certain height in an empty ship's tank, spark formation can lead to a catastrophe. The same conditions cause problems in regard to the protection of underwater pipes, in that practical and economical difficulties are entailed in the replacement of damaged anodes, particularly when the pipe is at great depth and the anode is intended to last for many years. There can be little control of underwater pipes and the result is that the pipe is subjected to undesirable corrosion and the environment is subjected to contamination before the end of the life time of the pipe, all due to the fact that the anode material which would have been active for a long period of time falls from the supporting metal part and is unused.

The conditions can be particularly difficult in regard to underwater pipes, due to continuous movement on the sea bed, such conditions prevail in relatively shallow water and the North Sea shelf area is a typical example. If the sea bed is of sand, there will be travelling sand waves which can contain large stones and the sand waves polish the pipes clean after a relatively short period of time, even though these are protected in all possible known ways by coating with water-tight protective mass and casting in concrete, and galvanic anodes are intended to last the entire lifetime of the pipe, up to twenty years.

Previously known anodes comprise, as mentioned, a supporting metal part and the anode material is cast therearoaund and, in an attempt to determine how the errosion of the anode material is to take place, an electrically insulating coating material has been applied to one or more of the surfaces of the anode material. Erosion is thereby decreased at the coated portions, however, there is still the risk that erosion may take place in such a manner that large pieces of active anode material fall off and are lost. One of the reasons why the anode material is loosened from the cast support part is that the linear contraction of the anode material when it hardens around or on the supporting metal part is greater than that of the metal part, so that stresses or cracks occur in consequence of poor adhesion and, during a period of time, this leads to the penetration of the electrolyte, for example, sea water, between the supporting metal part and the anode material. Corrosion then takes place here also. In addition to the deterioration of the mechanical connection in this manner, the erosion also affects the electric contact between the supporting metal part and the material in the anode.

In order to achieve adequate mechanical strength between the anode material and the iron which is to be embedded in the anode material, it has hitherto been necessary to position the iron at a distance from one side of the anode which can constitute 25% of the thickness of the anode. The part of the anode material which is finally beneath the iron can constitute a significant percentage of the material, which is more or less useless, in part due to the screening, in part because the mechanical connection and thereby the electrical connection is so deficient that the remainder of the anode must be considered valueless.

The object of the invention is to provide an improvement in a galvanic anode where the contraction of the anode material, when it hardens on being cast onto the supporting metal part, does not have serious consequences as previously, and, in accordance with the invention, this is achieved in that the supporting metal parts has, or is provided with components which allow a substantially improved bond between the metal part and the anode material. The connection can thereby take place entirely in the side surface of the anode and the entire anode is then utilized.

In an embodiment example, the supporting metal part is welded-on expanded metal which, due to its mechanical properties, can accompany the anode material when this contracts during hardening, without the connection between the expanded metal and the supporting metal part being affected.

A second embodiment example resides in the casting of the expanded metal into the anode body, without any actual supporting metal; lugs of, for example, flat iron or round iron, which prior to casting were secured to the side of the expanded metal, project from the anode body to serve for welding or bolting to the construction to be protected.

The invention is characterized by the features set forth in the claims.

The invention is further explained in the following with reference to the drawings which illustrate a number of embodiment examples of galvanic anodes effected in accordance with the invention.

Figure 1:
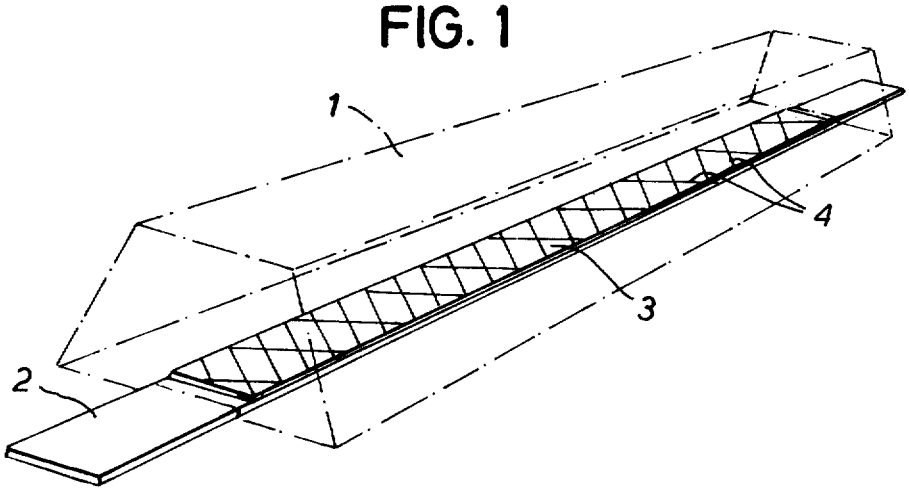
FIG. 1 shows an embodiment of the invention.

FIG. 1 is an elongate anode 1 of trapezoidal cross-section. The anode material is cast onto a supporting metal part 2, and to one side thereof, expanded metal 3 is attached which is welded to the metal part 2 at points disposed such that the expanded metal 3 can expand and contract to a certain degree together with the anode material when this contracts on hardening, without the connection points between the expanded metal 3 and the supporting metal part being affected.

Figure 2:
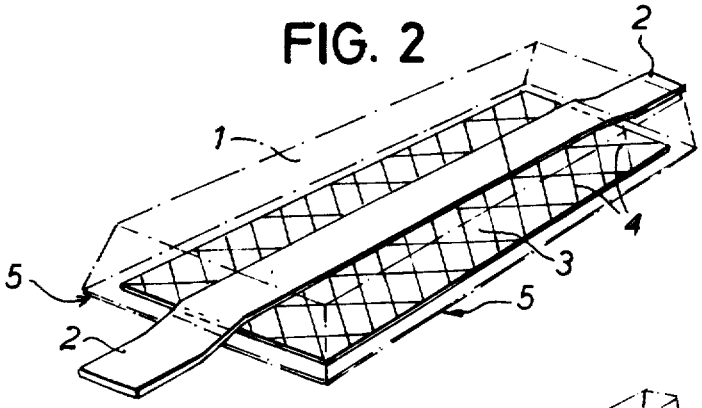
FIG. 2 shows another embodiment of the invention.

On hardening, the anode material contracts in all directions and it is important that the expanded metal 3 is cut such that the "network" extends obliquely on the side edges of the expanded metal, as indicated by lines 4. It is thereby possible for the expanded metal to expand in all directions. In the embodiment of FIG. 1, the expanded metal 4 is within the supporting metal part, however, there is no reason why the expanded metal should not be disposed outside the metal part, as indicated on FIG. 2. Furthermore, the expanded metal 3 is here of a width which is substantially greater than the width of the supporting metal part 2 and is then even more capable of accompanying the contractions of the anode material when this hardens. Also here, the expanded metal is cut such that the "network" extend obliquely on the side edges of the expanded metal. In certain cases, it may be to advantage to reduce the erosion of the anode material on the side of the anode which is closest to the expanded metal and the supporting part, and this can be carried out by an electrically insulating coating 5 which is applied to the underside of the anode on FIG. 2.

Figure 3:
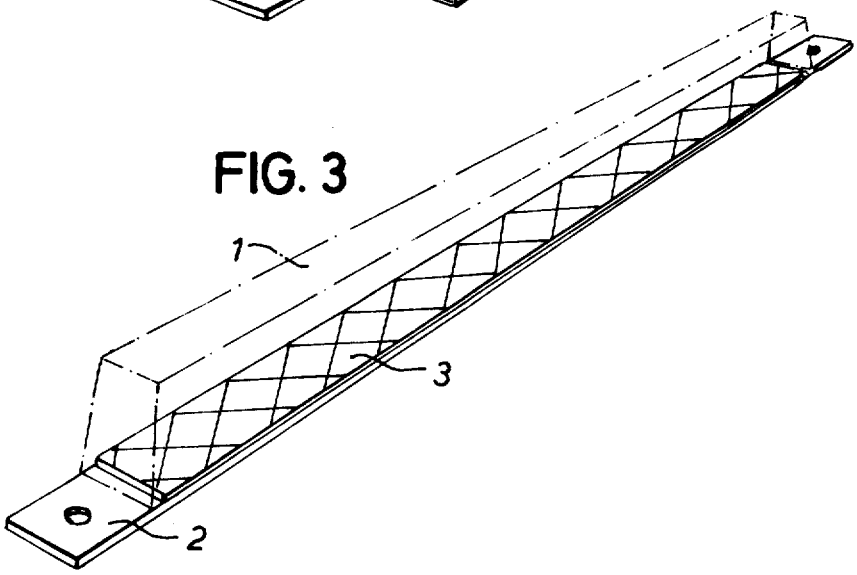
FIG. 3 shows yet another embodiment of the invention.

Another way of protection of one side of the anode is to allow the erodable metal part 2 to cover one side of th anode material, as illustrated on FIG. 3. Here also, the supporting metal part 2 is provided with expanded metal 3 welded thereupon and having the same properties as described hereinabove. Even though electrolyte were to penetrate between the anode 1 and the supporting metal part 2, so that erosion occured, the expanded metal 3 would be so well embedded in the anode material 1 both in the embodiment on FIG. 3 and the previously described embodiments, that the anode material would be bonded to the expanded metal until it is entirely used up.

Figure 4:
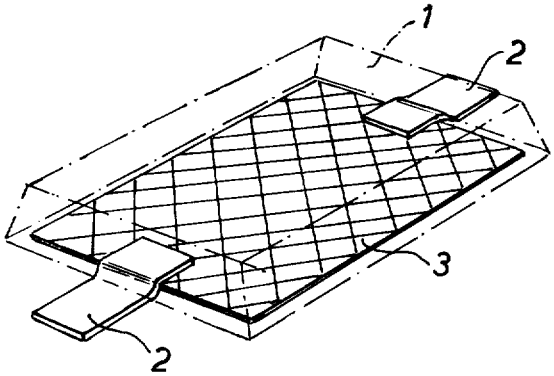
FIG. 4 shows yet another embodiment of the invention.

A variation of the embodiment examples described hitherto is illustrated in FIG. 4 where the anode body 1 can be secured to the construction by the lugs 2 which are, in turn, secured to the expanded metal 3.

Figure 5:
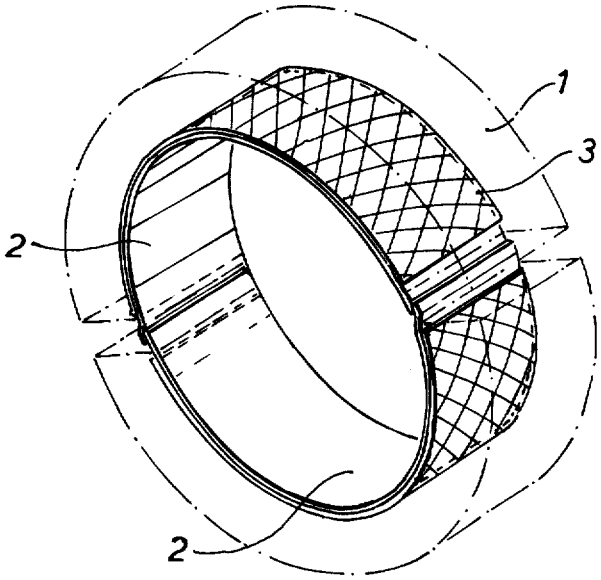
FIG. 5 shows yet another embodiment of the invention.

FIG. 5 illustrates a special embodiment example which is suitable for protection of pipes. The supporting metal part 2 is effected as two half-portions of a circle, with ends effected so as to fit one another and capable of being welded together when the anode is fastened around the pipe. In that the supporting metal part 2 protects the inside of the anode material 1 from erosion, the anode material is entirely consumed by erosion from the exterior of the anode. Expanded metal is used as indicated at 3 to provide a good bond both mechanically and electrically between the supporting part 2 and the anode material 1.

The examples shown serve merely to illustrate the invention and form no restriction of the protection afforded by this patent since other embodiment examples may well be envisaged within the scope of the invention, for example, in place of expanded metal, stamped tabs and tongues may be used which are bent upwardly from the plane through the supporting metal part. The length of the tongue is then adapted so that, to a resonable degree, it can accompany the contraction of the anode material when this hardens.

Having described my invention, I claim:

1. In an anode used for electrolytic protection of metal construction from corrosion, which anode includes an anode material cast onto a supporting metal structure for suspending or securing the anode to the construction to be protected, the improvement wherein:
   said supporting metal structure comprises;
   main support means extending along one side of and beyond said anode material, and
   an expansible network of metal bonded to at least a portion of said one side of said anode material, and operable to hold said main support means in position while expanding and contracting with said anode material.

2. The improvement according to claim 1, wherein: said expansible network of metal is disposed between said main support means and said anode material, and
   said main support means is bonded to said expansible network of metal.

3. The improvement according to claim 2, wherein said one side of said anode material is covered by said supporting metal structure.

4. The improvement according to claim 1, wherein said main support means is disposed between said expansible network of metal and said anode material.

5. The improvement according to claim 4, wherein said one side of said anode material is covered by said supporting metal structure.

6. The improvement according to claim 1, wherein said one side of said anode material is covered by said supporting metal structure.

7. The improvement according to claim 1, wherein said expansible network of metal comprises expanded metal, providing a network of thin elements.

8. The improvement according to claim 7, wherein said network of thin elements extends obliquely on the side edges of said expanded metal.

* * * * *